United States Patent [19]

Biersteker

[11] Patent Number: 4,670,985

[45] Date of Patent: Jun. 9, 1987

[54] VIBRATION MOUNT IN A CHAINSAW

[75] Inventor: Mel Biersteker, Venice, Calif.

[73] Assignee: McCulloch Corporation, Los Angeles, Calif.

[21] Appl. No.: 682,372

[22] Filed: Dec. 17, 1984

[51] Int. Cl.[4] ..... B27B 17/00

[52] U.S. Cl. ..... 30/381; 173/162 R

[58] Field of Search ..... 30/381, 382, 383; 173/162; 180/228

[56] References Cited

U.S. PATENT DOCUMENTS

| | | | |
|---|---|---|---|
| 3,224,473 | 12/1965 | Dobbertin et al. | 173/162 |
| 3,409,056 | 11/1968 | Rauh | 173/162 |
| 3,525,373 | 8/1970 | Kobayashi | 173/162 |
| 3,530,909 | 9/1970 | Scharpf | 30/383 X |
| 3,542,095 | 11/1970 | Frederickson et al. | 173/162 |
| 3,620,269 | 11/1971 | Lange | 30/381 |
| 3,651,839 | 3/1972 | Stihl et al. | 173/162 X |
| 3,698,455 | 10/1972 | Frederickson et al. | 173/162 X |
| 3,728,793 | 4/1973 | Makinson et al. | 30/383 |
| 3,733,700 | 5/1973 | Notaras et al. | 30/381 |
| 3,772,784 | 11/1973 | Heerman | 173/162 X |
| 3,783,961 | 1/1974 | Hooper | 180/228 |
| 3,845,557 | 11/1974 | Bailey | 30/381 |
| 3,845,827 | 11/1974 | Schulin | 173/162 |
| 4,010,544 | 3/1977 | Siman | 30/381 |
| 4,135,301 | 1/1979 | Hoeppner | 30/381 |
| 4,138,812 | 2/1979 | Zimmerer et al. | 30/381 |
| 4,198,752 | 4/1980 | Bross | 30/381 |
| 4,202,096 | 5/1980 | Nagashima | 30/381 |
| 4,261,105 | 4/1981 | Love | 30/383 |
| 4,285,309 | 8/1981 | Johansson | 30/383 X |
| 4,411,071 | 10/1983 | Takahashi et al. | 30/381 |

FOREIGN PATENT DOCUMENTS

| | | | |
|---|---|---|---|
| 1363513 | 8/1974 | United Kingdom | 180/228 |

*Primary Examiner*—Howard N. Goldberg
*Assistant Examiner*—Taylor J. Ross
*Attorney, Agent, or Firm*—Murray and Whisenhunt

[57] ABSTRACT

A chain saw having reduced transmission of vibration includes an internal combustion engine, a crankcase, and a crankshaft; a support assembly, the support assembly including a frame and at least one manual gripping handle; and a vibration isolation system for connecting the engine and the support assembly and inhibiting the transmission of vibration. The vibration isolation system comprises: a front vibration mount having an axis parallel to the crankshaft for connecting the crankcase to the front of the frame and a rear vibration mount having an axis parallel to the crankshaft for connecting the cylinder of the engine to the rear of the frame. The front vibration mount and the rear vibration mount are disposed so that a first imaginary line connecting their axes intersects an imaginary vertical plane containing the crankshaft at a point above the crankshaft. The front vibration mount and the rear vibration mount cooperate to permit relative twisting movement between the engine and the frame about the imaginary line. Cut control bumpers are disposed on an axis parallel to the crankshaft, the cut control bumpers being located between the engine and the frame at a position remote from the first imaginary line and such that a second imaginary line connecting the crankshaft and the cut control bumper axis intersects the first imaginary line at a point further from the cut control bumper axis than the crankshaft, the cut control bumpers inhibiting the relative twisting movement between the engine and the frame.

58 Claims, 18 Drawing Figures

VIBRATION MOUNT IN A CHAINSAW

BACKGROUND OF THE INVENTION

1. Field of the Invention

This invention relates to a vibration isolation mount for a hand-held, motor-driven power tool. In particular, it relates to a vibration isolation mount for a chain saw.

2. Description of the Prior Art

Hand-held, motor-driven power tools, particularly chain saws driven by an internal combustion engine, are subject to vibration caused by the non-uniformity of the drive and mass forces acting on the unit. These vibrations of the unit are transmitted to the hands and body of the operator and may cause early fatigue of the operator, numbness in the arms of the operator, and, over a long term of use, may injure the health of the operator. Many attempts to overcome this problem are disclosed in the prior art.

Rauh, U.S. Pat. No. 3,409,056, discloses a portable chain saw having a drive engine and a support handle unit having a transverse and a longitudinal handle rigidly interconnected with vibration damping bushings at the ends of the transverse handle and the rear end of the longitudinal handle which connect the handle to the saw unit and eliminate vibration. The vibration damping bushings are rubber-like resilient mountings, the axes of which are parallel to the axis of rotation of the engine crankshaft so as to insure a strong damping action and cause the mountings to be stressed mainly in shear and less in compression or tension.

Frederickson et al, U.S. Pat. No. 3,542,095, discloses a chain saw comprising a first assembly including an engine, a guide bar and a drive system and a second assembly including a fuel tank and carburetor. Vibration isolating means are interposed between the two assemblies. A handle network defines a cage-like structure, within which the first assembly is resiliently supported by vibration isolating units. The vibration isolating units define a generally triangular shock absorbing network more or less aligned with a principal vibration plane and disposed about the center of mass of the vibration generating assembly (the center of mass being more or less adjacent to the axis of rotation of the engine crankshaft in many commercial chain saws).

Lange, U.S. Pat. No. 3,620,269, discloses a chain saw wherein vibrations from the engine to the handle are absorbed by forming the handle with a core which is rigidly attached to the chain saw body and a sheath which surrounds the handle in spaced apart relation and is held relative to the core by a spacer of yieldable material. This spacer can take the form of a plurality of spaced rings of rubber or synthetic material having elastic properties. The damping action of the spacer can be varied to a desired degree by a choice of the resiliency of the elastic material, the radial distance between the core and the sheath, the length of the rings and the length of the intervals between the rings.

Sherwood, Jr. et al, U.S. Pat. No. 3,637,029, discloses a hand-held power tool comprising an internal combustion engine on which a power tool is mounted and by which it is driven. The engine is mounted by vibration isolators on an essentially rigid supporting structure comprising a base portion, a front handle and a rear handle. Four vibration isolators are so arranged as to isolate the supporting structure from vibration of the engine while providing effective control of the tool by an operator for holding the supporting structure by the front and rear handles. The vibration isolators are in the form of hollow barrel-shaped bodies of elastomeric material. The four vibration isolators supporting the engine are located at the apices of a tetrahedron. Three of the isolators are located at the front of the engine with two of them below the engine and on opposite sides while the third is located above the engine and at one side. The fourth vibration isolator is located at the rear of the engine. Two of the isolators are positioned with their axes approximately horizontal and parallel with the engine crankshaft while the other isolators are positioned with their axes vertical. In all instances, the axes of the isolators are perpendicular to a fore-and-aft direction (the axis of the engine cylinder). By reason of the isolators having a higher spring constant in a direction axially of the isolator and a lower spring constant in a direction perpendicular to the axis, the transmission of engine vibration to the supporting structure is effectively attenuated.

Frederickson et al, U.S. Pat. No. 3,698,455, discloses a vibration isolation and bumper system for a chain saw. In particular, a first assemblly generates mechanical vibrations and includes an internal combustion engine, a cutting chain with a guide bar and a drive system. A second assembly comprises an inertia mass and may include a fuel tank and a carburetor. Vibration isolation means connect the two assemblies and the second assembly may include a handle network provided to define a cage-like structure. The first assembly is resiliently supported within the cage-like structure by the vibration isolation means and bumper devices. The axis of rotation of the crankshaft within the engine and the cutting plane of the overall saw are arranged to direct a substantial portion of the total vibrational energy along a primary plane of vibration. The vibration isolation means and bumper devices are aligned with and cooperate to absorb shock energy directed along this primary plane.

Makinson et al, U.S. Pat. No. 3,728,793, discloses a chain saw having means for damping or reducing shocks and vibrations transmitted between the chain saw body and the operator. The chain saw has two separate handles, one near the front and one near the rear. Each of the handles has shock-absorbing or damping means at the end portion thereof connected to the engine. For the front handle, the upper shock-absorbing means for the upper end of the handle is postioned at an angle to the vertical and, preferrably, generally perpendicular to the general direction in which the operator's arm extends back and away from the handle. This places the shock-absorbing or damping element in shear. The lower shock-absorbing means for the lower end portion of the front handle allows limited pivotal movement of the front handle relative to the chain saw body, with the shock-absorbing or damping element placed in torsion. For the back handle, both upper and lower shock-absorbing means connecting the handle to the chain saw extend generally perpendicular to the longitudinal extent of the chain saw and to the operator's arm, with the shock-absorbing or damping element placed in shear.

Notaras et al, U.S. Pat. No. 3,733,700, discloses a dual grip handle for power tools, the grip comprising a first handle member flexibly connected to the power unit, a second handle member flexibly connected to the power unit, and a means for flexibly interconnecting the first and second handle members.

Bailey, U.S. Pat. No. 3,845,557, discloses a chain saw anti-vibration system wherein a vibration generating assembly is connected to a support assembly by a plurality of vibration isolation assemblies. Each vibration isolation assembly includes a first cup mounted upon one of the vibration generating assembly or the support assembly and a post mounted upon the other of the vibration generating assembly or the support assembly. The post is dimensioned to be coaxially received within the interior of the first cup. Each of the vibration isolation assemblies includes a second cup of an elastomeric material dimensioned to contiguously fit within the interior of the first cup. The second cup is provided with at least one elastomeric circumferentially inwardly projecting ring dimensioned to engage under hoop tension at least a portion of the exterior surface of the post whereby relative vibrations between the post and the first cup will be attenuated by the elastomeric second cup. Moreover, two annular rings formed on the exterior of the second cup serve to contact the interior surface of the first cup. By this design, the vibration mounts initially resist vibrational forces by elastomeric bending (shearing) of the second cup, which with increasing magnitude of the vibrational force makes a transition to solid compression of the second cup. Additionally, the mounts are oriented to have their axes lie in the primary plane of vibration, which is substantially perpendicular to the crankshaft axis.

Schulin, U.S. Pat. No. 3,845,827, discloses a portable tool, especially a chain saw, having a handle connected to the tool through a spring elastic connector. A compensator mass is connected to the handle through another spring elastic connector and the compensator mass is free to oscillate relative to the handle. The oscillation of the compensator mass is in counter phase to that of the tool. The handle is elasticly coupled to both tool and compensator mass and located at approximately the vibration node or nodal point. The handle is therefor subject to small amplitudes of movement.

Nagashima, et al, U.S. Pat. No. 3,945,119, discloses a chain saw comprising an engine unit including an engine, a fuel tank, an oil tank and a chain driving system which is mounted on a handle assembly consisting of a front handle, a rear handle, and a handle connecting member interconnecting the front and rear handles and supporting the bottom of the engine unit through three vibration isolators. The rear end of the handle connecting mmber is joined through a vibration isolator to the rear end of the rear handle, and the front upper end of the rear handle is joined through a vibration isolator to the top of the engine unit. The upper end of the front handle is positioned in parallel with the upper end of the rear handle in the horizontal direction and joined thereto through a vibration isolator, and the lower end of the front handle is joined directly to the front end of the handle connecting member. The vibration isolators are made of an elastic material such as synthetic rubber and are of the inherent damping type which dampens and absorbs the vibrations by internal hysteresis, i.e., shearing stresses and strains in the vertical direction of the vibration isolators.

Hoeppner, U.S. Pat. No. 4,135,301, discloses a chain saw comprising a handle-housing member including at least one handle for carrying the saw; at least one crankcase member; and at least one means including a vibration-damping elastic member for providing a shock absorbing connection between the housing member and the crankcase member.

Zimmerer, et al, U.S. Pat. No. 4,138,812, discloses a vibration isolating system for chain saws characterized by a handle assembly connected to one side of a vibration generating assembly of a chain saw by a pair of resilient suspension means, with cross-over linkage means being operable to transmit force from the handle assembly to the other side of the vibration generating assembly, across the top of the engine means of this assembly.

Muller, U.S. Pat. No. 4,236,310, discloses a portable motor-driven working implement, e.g., a brush cutter, which includes a first implement part subject to vibrations which is connected to a second implement part on the other side of a handle of the implement through the inter position of at least one elastic insulating element, the rigidity characteristic of the insulating element being adjustable.

Johansson, U.S. Pat. No. 4,285,309, discloses a portable chain saw wherein the rear handle is, at least in part, connected to the vibration generating assembly by a pair of rubber anti-vibration members which are formed as cylinders with annular rings thereabout. These anti-vibration members are positioned in corresponding recesses in the vibrating assembly.

Takahashi et al, U.S. Pat. No. 4,411,071, discloses a chain saw wherein an imaginary line passing between a front mount and a rear mount appears to pass above the crankshaft axis of the engine, however, the engine in this reference is disposed horizontally (the cylinder axis is disposed parallel to the chain saw guide bar).

Von Hardenberg, Canadian Patent No. 985,251, discloses an engine mounting arrangement for an aircraft. The engine mounting arrangement includes front and rear mountings. The rear mounting includes a lower mount having near zero lateral restraint and an elastic vertical restraint and an upper mount having near zero vertical restraint and an elastic lateral restraint. The upper mount of the rear mounting is located vertically such that an imaginary straight line passing through the front mounting passes through the center of gravity of the engine. This mounting arrangement tends to place lateral inputs resulting from vibratory motion of the aircraft fuselage at a point on a line drawn through the front mounting and the center of gravity of the engine. This will inhibit the introduction of fuselage-induced roll moments to the engine. With this decoupling of the engine roll mode from air frame excitation, the engine response is predicted as being well within the manufacturers specified limit for virtually all flight conditions.

Other patents concerned with the damping of vibrations in chain saws include Stihl, U.S. Pat. No. 3,651,839; Heermann, U.S. Pat. No. 3,772,784; Dobbertin et al, U.S. Pat. No. 3,224,473; Kobayashi, U.S. Pat. No. 3,525,373; Nagashima, U.S. Pat. No. 4,202,096; and Dirks, U.S. Pat. No. 4,296,553.

As may be readily ascertained from the above discussion, the art continues to seek effective means for damping the vibrations caused by an internal combustion engine in a hand-held power tool.

SUMMARY OF THE INVENTION

It is an object of the present invention to provide a vibration isolation system for connecting a vibrating assembly to a support assembly for the vibrating assembly and inhibiting the transmission of vibrational forces from the vibrating assembly to the support assembly.

It is a further object of the present invention to provide a chain saw having reduced transmission of vibration to the user of the chain saw.

In a first aspect, the present invention provides a chain saw comprising a vibrating assembly having a front and a rear and a top and a bottom including an internal combustion engine with at least one cylinder, a crankcase and a crankshaft having a center line axis; a support assembly for supporting the vibrating assembly, the support assembly including a main frame having a front and a rear and at least one manual gripping handle; a vibration isolator for connecting the vibrating assembly and the support assembly and inhibiting the transmission of vibrational forces from the vibrating assembly to the support assembly, the vibration isolator comprising: a front vibration mount having an axis at least substantially parallel to the crankshaft center line axis for connecting the front of the vibrating assembly to the front of the main frame; a rear vibration mount having an axis at least substantially parallel to the crankshaft center line axis for connecting the rear of the vibrating assembly to the rear of the main frame; the front vibration mount and the rear vibration mount being disposed so that a first imaginary line connecting their axes intersects an imaginary vertical plane containing the crankshaft center line axis at a point above the crankshaft center line axis; the front vibration mount and the rear vibration mount cooperate to permit relative twisting movement between the vibrating assembly and the main frame about the first imaginary line; and cut control bumpers, having an axis at least substantially parallel to the crankshaft center line axis, located between the vibrating assembly and the main frame at a position remote from the first imaginary line, and located such that a second imaginary line connecting the crankshaft center line axis and the cut control bumper axis intersects with the first imaginary line at a point further from the cut control bumpers than the crankshaft center line axis, the cut control bumpers inhibiting the relative twisting movement between the vibrating assembly and the main frame.

In a second aspect, the present invention provides a chain saw comprising a vibrating assembly having a front including an internal combustion engine having a cylinder, a crankcase having a right side and a left side and a crankshaft having a center line axis; a support assembly for supporting the vibrating assembly, the support assembly including a main frame having a front and a right side and a left side and at least one manual gripping handle; a front vibration mount for connecting the front of the crankcase to the front of the main frame and inhibiting the transmission of vibrational forces from the vibrating assembly to the support assembly, the front vibration mount comprising: pin mreans having an axis parallel to the crankshaft center line axis for supporting the vibrating assembly, the pin means rigidly connected to the crankcase assembly; shearable, compressible, resilient member means having an axis and an axial bore therethrough for supporting the pin means, the axial bore coaxially receivably engaging at least a portion of the pin means therein; recess means having an axis, formed in the main frame, for supporting the shearable, compressible, resilient member means, the recess means coaxially receivably engaging the shearable, compressible, resilient member means; the resilient member means cooperates with the recess means to maintain the main frame and the crankcase assembly in spaced apart relation and attenuates the transmission of vibration from the vibrating assembly to the support assembly in a direction parallel to the crankshaft center line axis by compression of the resilient member means; the pin means cooperates with the resilient member means to prevent shear of the resilient member means in a plane transverse to the crankshaft center line axis, whereby the front mount attenuates the transmission of vibration from the vibrating assembly to the support assembly substantially only by compression of the resilient member means.

In a third aspect, the present invention provides a chain saw comprising a vibrating assembly including an internal combustion engine having a cylinder, a crankcase and a crankshaft having a center line axis; a support assembly for supporting the vibrating assembly, the support assembly including a main frame having a rear and a right side and a left side and at least one manual gripping handle; a rear vibration mount for connecting the cylinder to the rear of the main frame an inhibiting the transmission of vibrational forces from the vibrating assembly to the support assembly, the rear vibration mount comprising: roll pin means having end portions and an axis substantially parallel to the crankshaft center line axis for supporting the vibrating assembly, the roll pin means rigidly connected to the cylinder; cup means for coaxially receiving and supporting the roll pin means; shearable, compressible, resilient member means having an axis, intermediate the roll pin means and the cup means, for maintaining the roll pin means and the cup means in coaxially spaced apart relationship; heat shield means, intermediate the roll pin means and the resilient member means, for inhibiting heat transfer from the cylinder to the resilient member means; aperture means having an axis, formed in the main frame, for coaxially receivably engaging at least a portion of the cup means and supporting the cup means. The resilient means maintains the vibrating assembly and the support assembly in spaced apart relationship and attenuates the transmission of vibration from the vibrating assembly to the support assembly substantially only by compression of the resilient member means.

In a fourth aspect, the present invention provides a chain saw comprising a vibrating assembly including an internal combustion engine having a cylinder, a crankcase having a right side and a left side and a crankshaft having a center line axis; a support assembly for supporting the vibrating assembly, the support assembly including a main frame having a front and a rear and a right side and a left side, and at least one manual gripping handle; and a vibration isolator for connecting the vibrating assembly to the support assembly and inhibiting the transmission of vibrational forces from the vibrating assembly to the support assembly, the vibration isolator comprising: front vibration mount means for connecting the crankcase to the front of the main frame comprising pin means having an axis parallel to the crankshaft center line axis for supporting the vibrating assembly, the pin means rigidly connected to the crankcase; first shearable compressible resilient member means having an axis and an axial bore therethrough for supporting the pin means, the axial bore coaxially receivably engaging at least a portion of the pin means therein; recess means, having an axis, formed in the main frame, for supporting the first shearable compressible resilient member means, the recess means coaxially receivably engaging the front shearable compressible resilient member means; the first resilient member means cooperates with the recess means to maintain the main frame and the crankcase in spaced apart relation and attenuates the transmission of vibration from the vibrating assembly to the support assembly in a direction parallel to the crankshaft center line axis by compression of the first resilient member means; the pin means cooperates with the first resilient member means to prevent shear of the resilient means in a plane transverse to the crankshaft center line axis, whereby the front mount means attenuates the transmission of vibration from the vibrating assembly to the support assembly substantially only by compression of the first resilient member means; and rear vibration mount means for connecting the cylinder to the rear of the main frame comprising roll pin means having end portions and an axis parallel to the crankshaft center line axis for supporting the vibrating assembly, the roll pin means rigidly connected to the cylinder; second shearable compressible resilient member means having an axis and an axial bore therethrough for supporting the roll pin means, the end portion of the roll pin means coaxially receivably engaged within the axial bore; heat shield means, intermediate the pin means and the second resilient member means, for inhibiting heat transfer from the cylinder to the second resilient member means; cup means, having an axis, for supporting the second resilient member means, the cup means coaxially receivably engaging the second resilient member means; aperture means having an axis, formed in the main frame for coaxially receivably engaging at least a portion of the cup means and supporting the cup means; the second resilient member means maintaining the vibrating assembly and the support assembly in spaced apart relationship and attenuating the transmission of vibration from the vibrating assembly to the support assembly substantially only by compression of the second resilient member means.

DESCRIPTION OF THE PREFERRED EMBODIMENTS

Figure 1:
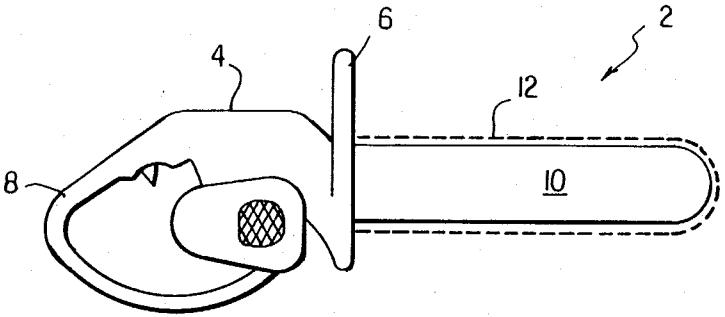
FIG. 1 is an illustration of a chain saw according to the present invention.

FIG. 1 is an illustration of a chain saw, generally indicated at 2, according to the present invention which includes a housing 4 containing an internal combustion engine (not shown), a front manual gripping handle 6, a rear manual gripping handle 8 and a guide bar 10. The guide bar 10 is connected to the engine and extends forwardly therefrom. An endless cutter chain 12 is disposed about and slidingly supported on the guide bar 10. The endless cutter chain 12 is drivingly connected (not shown) to the engine for rotation of the endless cutter chain about the guide bar 10.

Figure 2:
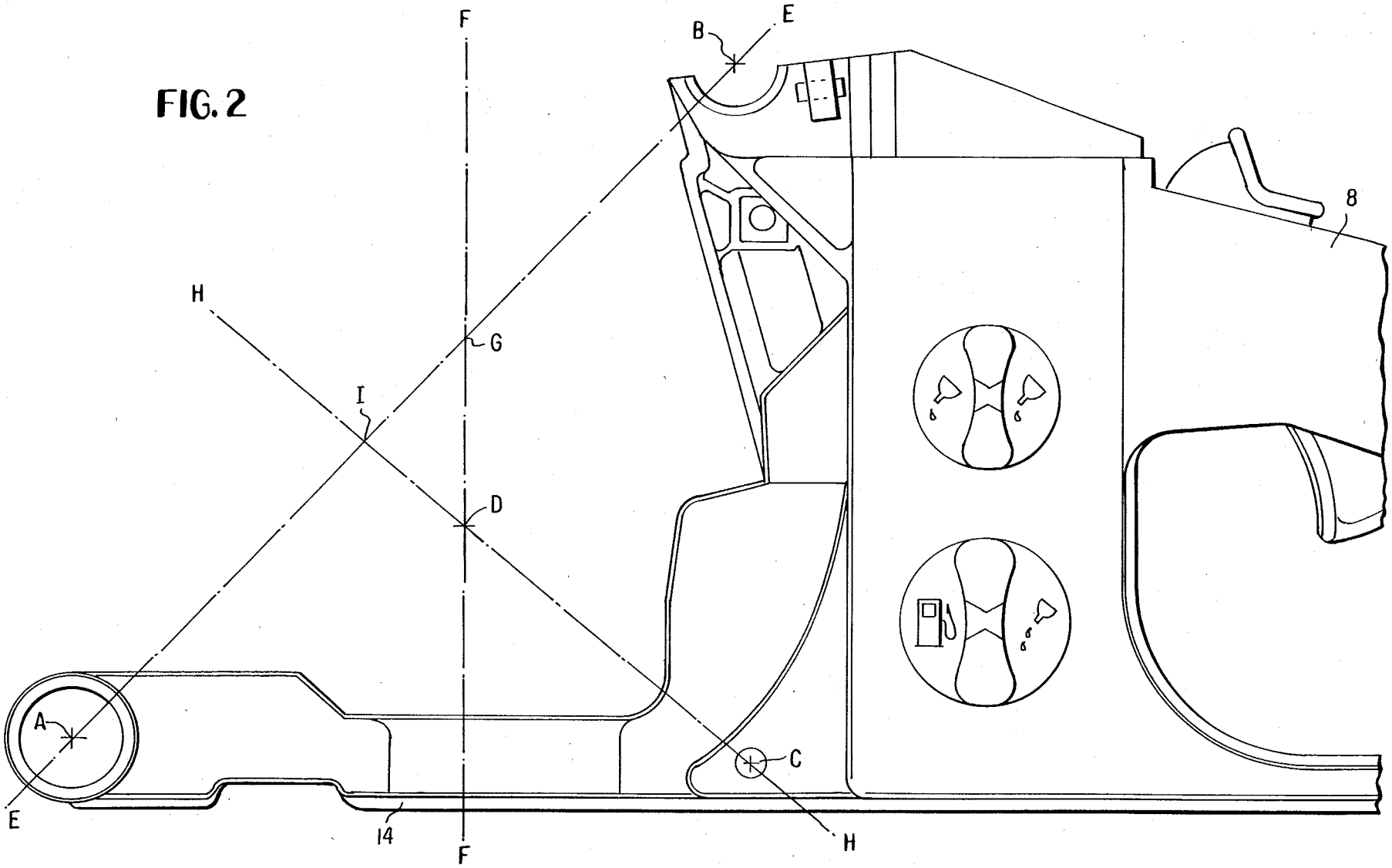
FIG. 2 is an illustration of a main frame according to the present invention.
Figure 3:
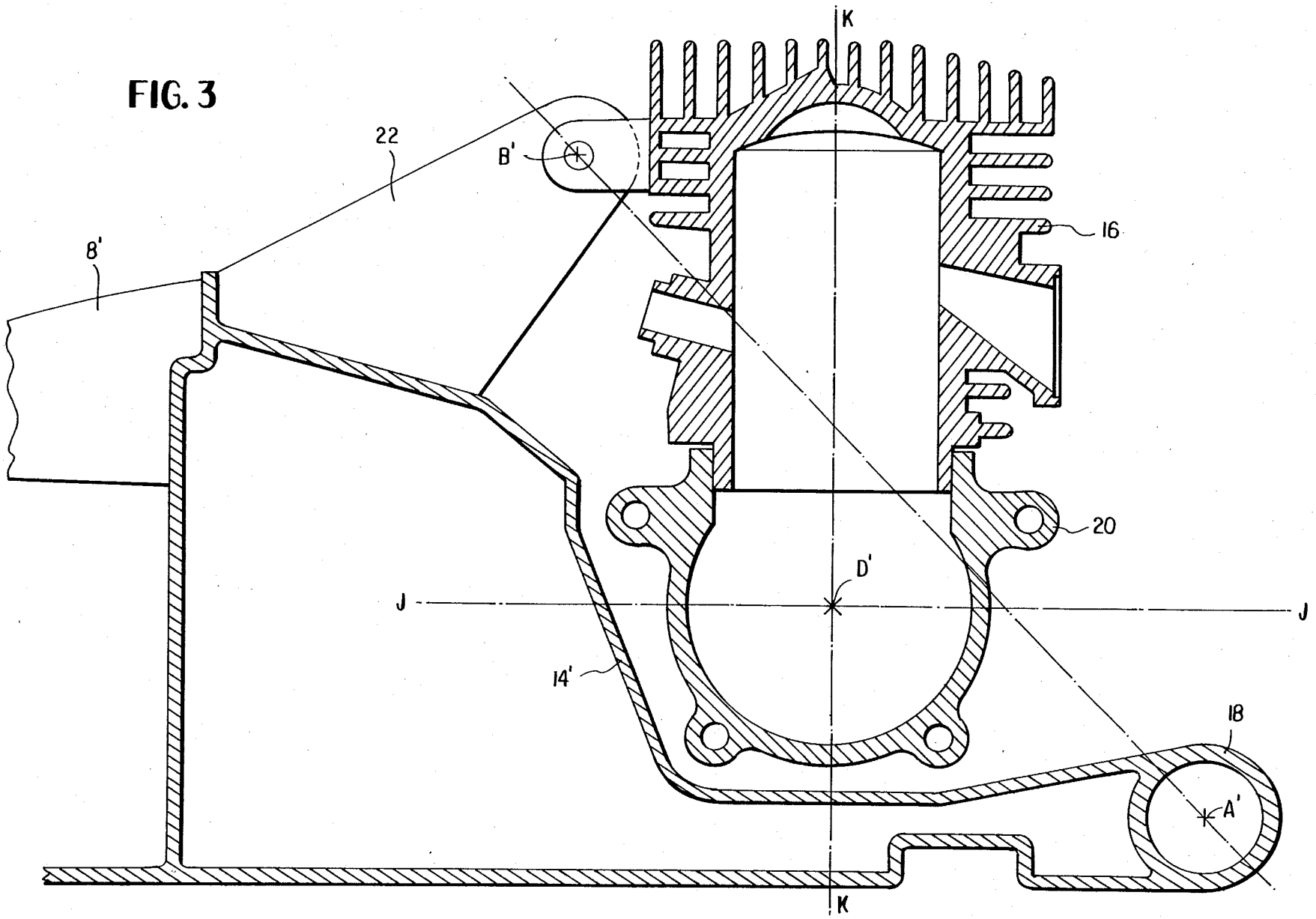
FIG. 3 is another illustration of a main frame according to the present invention with an engine cylinder in place.

The housing 4 contains a main frame 14, (14'), as best seen in FIGS. 2 and 3, for supporting the internal combustion engine of the chain saw. As shown in FIG. 2, the main frame 14 is rigidly attached to the rear manual gripping manual handle 8 (as by bolts—not shown) or by forming the rear manual gripping handle integrally with the main frame. The internal combustion engine is connected to and vibrationally isolated from the main frame by the utilization of a front mount (not shown) having an axis A, a rear mount (not shown) having an axis B and a pair of cut control bumpers (not shown) having an axis C. Each of these axes is substantially parallel to the crankshaft center line axis D of the internal combustion engine (as shown in FIG. 2, each of the axes A, B, C and D are perpendicular to the plane of the drawing sheet and extend outwardly therefrom). The axes of the front mount A and the rear mount B are disposed so that a first imaginary line E—E connecting the axes of the front mount and the rear mount intersects an imaginary vertical plane F—F containing the crankshaft centerline axis D at a point G above the crankshaft center line axis D. The axis of the cut control bumpers C is located at a position remote from the first imaginary line E—E and is located such that a second imaginary line H—H connecting the crankshaft center line axis D and the cut contol bumper axis C intersects the first imaginary line E—E at a point I further from the cut control bumper axis C than the crankshaft center line axis D.

As may be more clearly seen from FIG. 3, the mainframe 14' is connected to the internal combustion engine through a front vibration mount (not shown) having an axis A' and a rear vibration mount (not shown) having an axis B'. The crankshaft center line axis D' lies in a substantially horizontal plane J—J and the axis K—K of the cylinder 16 of the internal combustion engine is substantially perpendicular to the horizontal plane J—J containing the crankshaft center line axis D', the cylinder 16 extending above the horizontal plane J—J. The front vibration mount (not shown) having an axis A' is located forward of and below the crankshaft centerline axis D', the front vibration mount connecting the front 18 of the mainframe 14' to the crankcase of the internal combustion engine (only a portion 20 of the crankcase being illustrated). The rear vibration mount (not shown) having an axis B' connects the rear 22 of the mainframe 14' to the cylinder 16 of the internal combustion engine.

Figure 4:
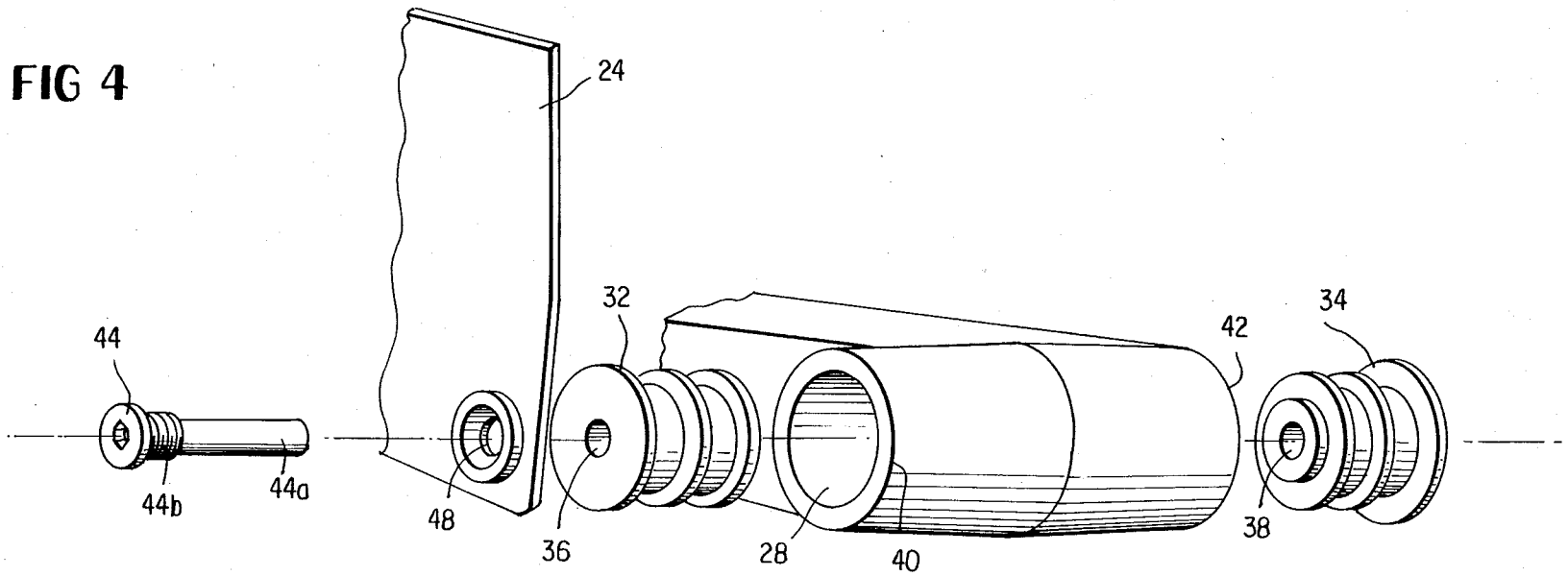
FIG. 4 is an exploded view of a portion of a front vibration mount according to the present invention.
Figure 5:
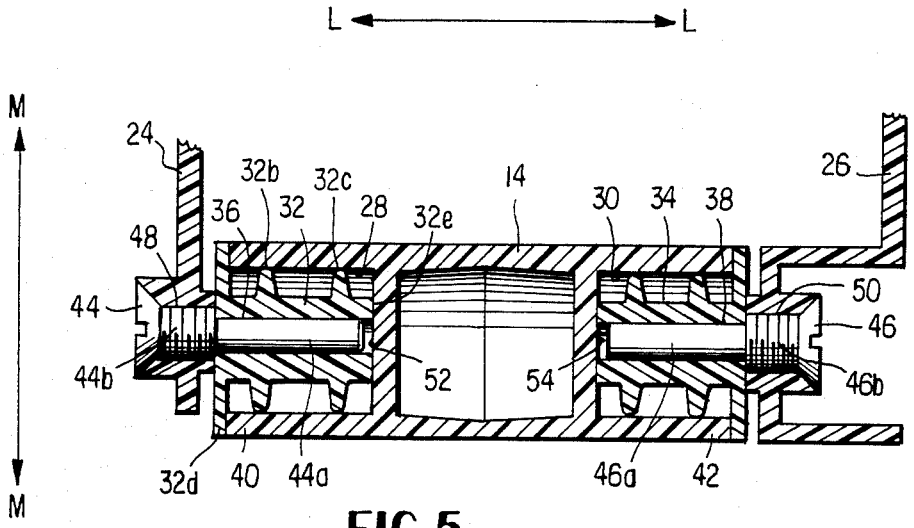
FIG. 5 is a cross-sectional view of a front mount according to the present invention.

As shown in FIGS. 4 and 5, the crankcase has a right side 24 and a left side 26. A pair of axially aligned substantially cylindrical recesses 28, 30 are formed in the mainframe 14, one of the pair of recesses 28 formed on the right side of the mainframe and the other of the pair of recesses 30 formed on the left side of the mainframe. A pair of axially aligned substantially cylindrical resilient members 32, 34 are provided, each of the pair of resilient members having an axial bore therethrough, 36 and 38, respectively. One of the resilient members 32 is coaxially received within the right side recess 28 and the other of the resilient members 34 is coaxially received within the left side recess 30. The right side resilient member 32 holds the right side 40 of the mainframe 14 and the right side 24 of the crankcase in spaced apart relationship. Likewise, the left side resilient member 34 holds the left side 42 of the mainframe 14 and the left side of the crankcase 26 in spaced apart relationship. The resilient members, 32 and 34, attenuate the transmission of vibrations from the crankcase to the mainframe, in a direction parallel to the crankshaft center line axis (as shown by the arrow L—L) by compression of the resilient members 32 and 34. A pair of rigid pins 44, 46 are provided to support the crankcase. A portion 44*a* of the pin 44 is received within the axial bore 36 of the right side resilient member 32 and the remaining portion 44*b* of the pin 44 is rigidly connected to the right side 24 of the crankcase. Likewise, a portion 46*a* of the pin 46 is received within the axial bore 38 of the left side resilient member 34 and the remaining portion 46*b* of the pin 46 is rigidly connected to the left side 26 of the crankcase. The pins 44 and 46 cooperate with the respective resilient members 32, and 34 to prevent shearing of the resilient members in a plane transverse to the crankshaft center line axis, thereby attenuating vibrations in a direction transverse to the crankshaft center line axis (as shown by the arrow M—M) by compression of the resilient members 32 and 34. Thus, the front vibration mount attenuates the transmission of vibrations from the crankcase to the mainframe substantially only by compression of the resilient members.

Figure 6:
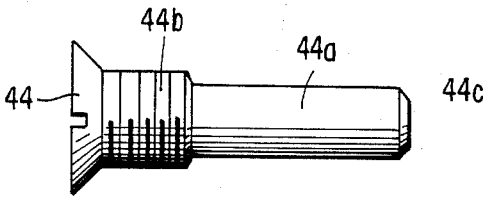
FIG. 6 is a side view of a pin utilizable in a front mount according to the present invention.

As may be more clearly seen in FIG. 6 the pin 44 (only the right side pin having been illustrated since the pins are of identical configuration) has a threaded portion 44*b* and an unthreaded portion 44*a*. The unthreaded portion 44*a* is engagingly received within the axial bore 36 in the resilient member 32. The threaded portion 44*b* is threadingly received within a corresponding threaded aperture 48 formed in the right side 24 of the crankcase (likewise, the threaded portion 46*b* of the pin 46 is received within a correspondingly threaded aperture 50 in the left side 26 of the crankcase).

Figure 7:
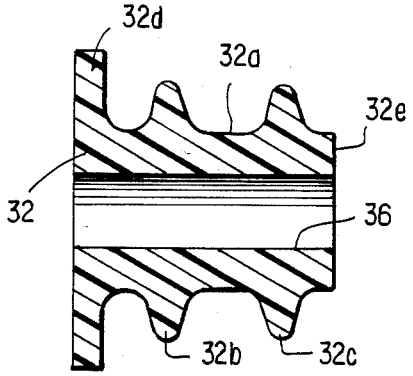
FIG. 7 is a cross-sectional view of a resilient member utilizable in a front mount according to the present invention.

As may best be seen in FIG. 7, the resilient member 32 (only one of the resilient members having been illustrated since they are of identical configuration) comprises a substantially cylindrical body portion 32*a* having a pair of axially spaced apart annular rings 32*b*, 32*c* thereon. A flange portion 32*d* extends perpendicular to the axis of the cylindrical body at one end of the body portion 32*a*. In use, the flange portion is disposed abbutingly between the right side of the main frame 40 and the right side 24 of the crankcase, and the annular rings 32*b*, 32*c* and the other end 32*e* of the cylindrical body portion 32*a* abut the interior of the recess 28 in the main frame 14. As may best be seen in FIG. 5, the unthreaded portion 44*a* of the pin 44 which is received within the axial bore 36 of the resilient member 32 extends through the axial bore substantially over the complete length of the axial bore so as to support the resilient member 32 and prevent shearing thereof. However, the unthreaded portion 44*a* of the pin 44 does not extend completely through the axial bore 36 of the resilient member 32 so that a gap is formed between the end 44*c* of the pin 44 and the interior of the recess 28, this gap 52 allowing compression of the resilient member 32 in the direction parallel to the crankshaft center line axis. Likewise, a similar gap 54 is formed between the pin 46 and the interior of the recess 30.

Figure 8:
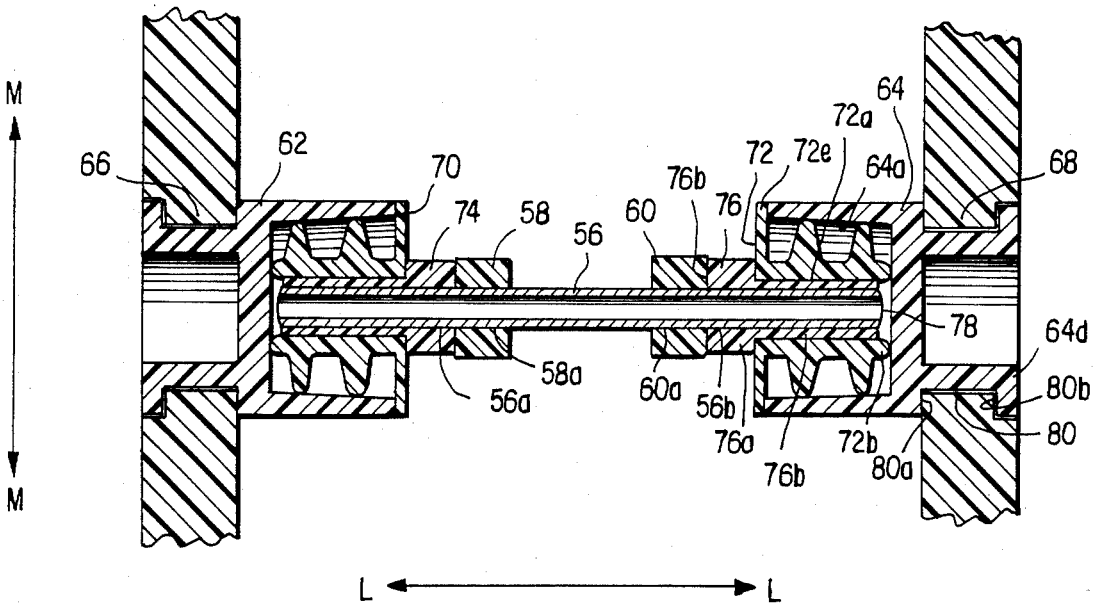
FIG. 8 is a cross-sectional view of a rear mount according to the present invention.

The rear vibration mount is illustrated in FIG. 8. The rear vibration mount comprises a roll pin 56 rigidly connected to the cylinder (not shown) by a pair of bosses 58 and 60 extending from the cylinder. A pair of cup members 62 and 64 are provided for coaxially receiving and supporting the roll pin 56, each of the cup members 62 and 64 received within and supported by a corresponding aperture 66 and 68, respectively, formed in the main frame 14. A shearable compressible resilient member 70, 72 is provided intermediate the roll pin 56 and the respective cup members 62 and 64 so as to maintain the roll pin 56 and the cup members 62 and 64 in coaxial spaced apart relationship. The roll pin 56 cooperates with the resilient members 70, 72 to prevent shear of the resilient members in a direction transverse to the crankshaft center line axis (as shown by the arrow M—M). A heat shield member 74, 76 is provided intermediate the roll pin 56 and a respective resilient member 70, 72 for inhibiting the transfer of heat from the cylinder to the resilient member.

Figure 9A:
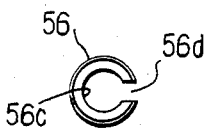
FIGS. 9A and 9B are an end view and a side view, respectively, of a roll pin utilizable in the present invention.
Figure 9B:
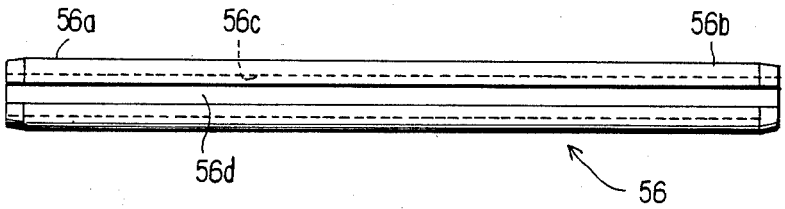

As may best be seen in FIGS. 9A and 9B, the roll pin 56 comprises a substantially cylindrical body having end portions 56*a* and 56*b*. Preferably, the roll pin 56 has an axial bore 56*c* extending therethrough so as to minimize the area for heat transfer from the cylinder to the resilient members. Additionally, the roll pin 56 preferrably has a longitudinally extending slot 56*d* extending parallel to the axis of the roll pin over the entire length of the entire body of the roll pin. This slot allows for a ready press fit of the roll pin into axial bores formed in the bosses 58 and 60 extending from the cylinder 16, as will be explained more fully hereinafter. Additionally, the slot 56*d* further decreases the area available for heat transfer from the cylinder to the resilient members. Desirably, the roll pin 56 may be formed of a material having a low thermal conductivity, e.g. stainless steel has been found to be suitable.

Figure 13A:
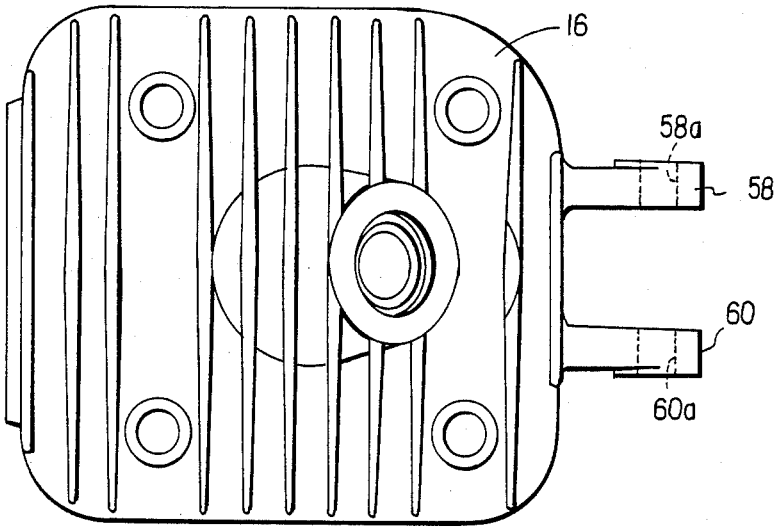
FIGS. 13A and 13B are a top view and a side view, respectively, of an engine cylinder according to the present invention.
Figure 13B:
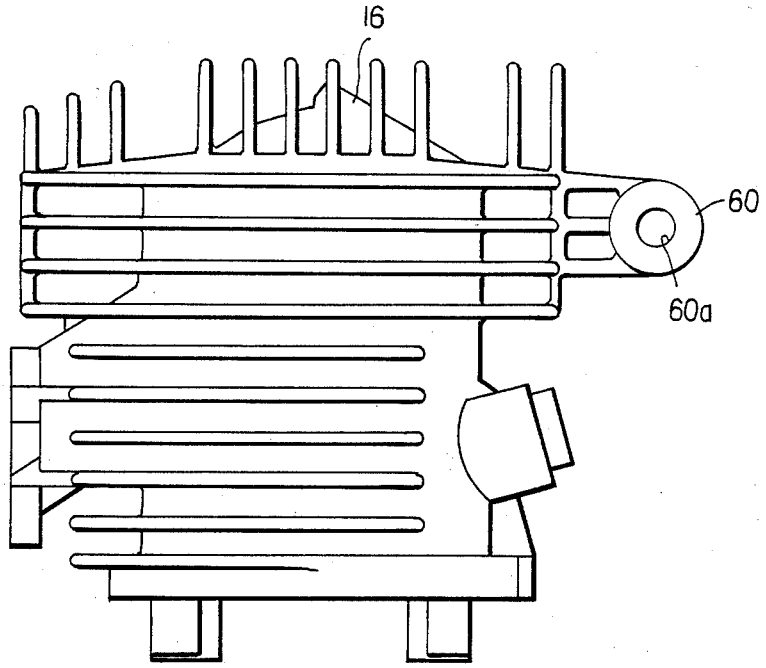

As may best been seen in FIGS. 13A and 13B, the cylinder 16 is provided with a pair of bosses 58 and 60 extending from the cylinder. Each of the bosses 58 and 60 has a bore 58*a* and 60*a*, respectively, therethrough. The bores 58*a* and 60*a* are coaxially aligned with one another and the roll pin 56 is press fit through the bores with the end portions 56*a* and 56*b* of the roll pin extending out board of the respective bosses 58 and 60.

Figure 12A:
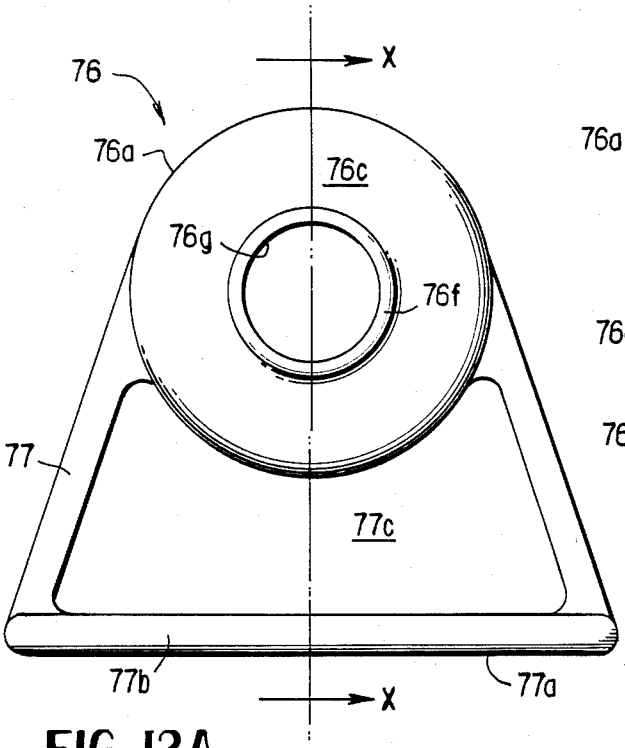
FIGS. 12A and 12B are an end view and a sectional view (taken along line X—X in FIG. 12A), respectively, of a heat shield member according to the present invention.
Figure 12B:
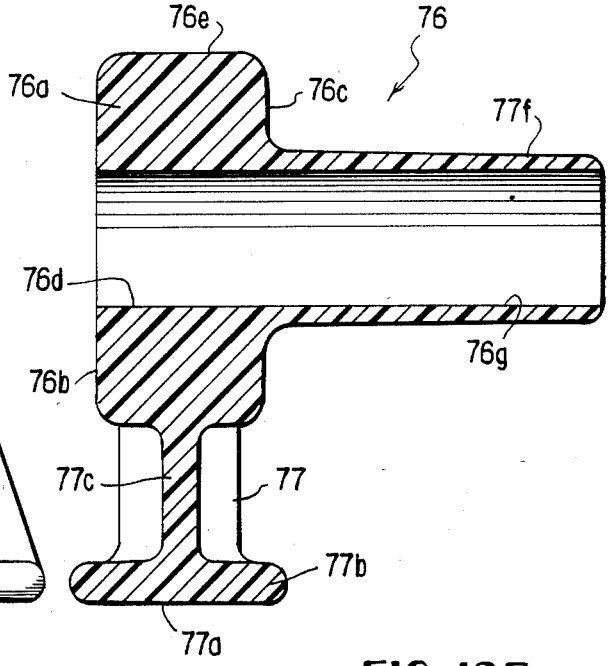

A respective heat shield member 74 and 76 is press fit over each of the end portions 56*a* and 56*b* of the roll pin 56. The heat shield members 74 and 76, as best seen in FIGS. 12A and 12B (only the left hand side heat shield member 76 being illustrated since the heat shield members are of identical configuration), each comprise a substantially planar annular disc portion 76*a* having a front face 76*b*, a rear face 76*c*, an inner edge 76*d* and an outer edge 76*e*. An inner cylindrical wall 76*f* extends substantially perpendicular from the rear face 76*c* of the disk 76*a* adjacent the inner edge 76*d*. The inner cylindrical wall 76*f* defines a hollow cylinder 76*g* which is press fittingly receivable in a respective end portion 56*b* of the roll pin 56. The heat shield member 76 further comprises a shroud portion 77 which lies substantially in the plane of the annular disc portion 76*a*. The shroud portion 77 is of substantially trapezoidal shape in plan with the longer side 77*a* of the two parallel sides of the trapezoid being disposed outwardly from the annular disc portion 76*a* and the shorter side of the two parallel sides of the trapizoid being integral with the annular disc portin 76*a*. The shroud portion is in the form of a flange-like portion 77*b* connected to the annular disc portion 76*a* by an integral web 77*c*. In use, the hollow cylinder 76*g* is press fit over the end portion 56*b* of the roll pin 56 and the front face 76*b* of the annular disc portion 76*a* abuttingly contacts the respective cylinder boss 60. The shroud portion 77 is oriented so that it extends toward the cylinder 16 with the longer side 77*a* extending substantially parallel to the axis of the cylinder 16. The heat shield members, 74 and 76, can be formed of a plastic having a low coefficient of thermal conductivity which retains sufficient structural strength at the temperatures in the environment of the engine cylinder, e.g., Nylon 66 or Nylon 6, preferably containing a fiber glass reinforcement. As may best be seen in FIG. 8, the hollow cylinder 76*g* which is press fit over the end portion 56*b* of the roll pin 56 extends substantially coextensively with the end portion 56*b* of the roll pin 56.

Figure 10:
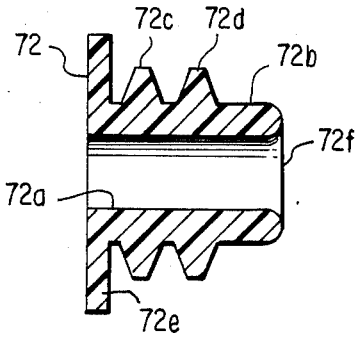
FIG. 10 is a sectional view of a resilient member utilizable in a rear mount according to the present invention.

The inner wall 76*f* of the heat shield member 76 is in turn fitted within an axially bore 72*a* formed within the resilient member 72. As may best been seen in FIG. 10 (only the left side resilient member being illustrated since both resilient members are of identical configuration), the resilient member 72 comprises a cylindrical body portion 72*b* having an axial bore 72*a* therethrough. A pair of axially spaced apart annular rings 72*c* and 72*d* are formed on the cylindrical body portion 72*b*. A flange portion 72*e* extends perpendicular to the axis of the body portion 72*b* at one end of the body portion. In use, the flange portion 72*e* is disposed abuttingly between the annular disk portion 76*a* of the heat shield member 76 and a cup member 64. The annular rings 72*c* and 72*d*, and the other end 72*f* of the resilient member are received within and abut the interior of a recess 64*a* formed within the cup member 64. As may best be seen in FIG. 8, the other end 72*f* of the resilient member 72 extends beyond the end portion 56*b* of the roll pin 56 and the inner wall 76*f* of the heat shield member 76 so as to form a gap 78 between the interior of the recess 64*a* and the end portion 56*b* of the roll pin 56. This gap 78 allows the resilient member 72 to attenuate the transmission of vibrations in a direction parallel to the crankshaft center line axis (as shown by the arrow L—L by compression of the resilient member 72.

Figure 11:
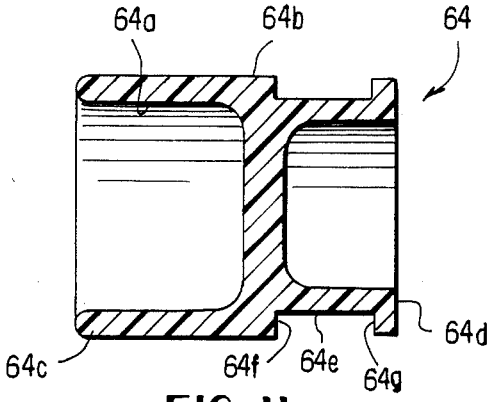
FIG. 11 is a sectional view of a cup member utilizable in the present invention.

As previously noted, the resilient member 72 is received within a recess 64*a* formed in cup member 64. As may best be seen in FIG. 11 (only the left hand side cup member having been illustrated since the cup members are of identical configuration), the cup member 64 comprises a substantially cylindrical body portion 64*b* having an inner end 64*c* and an outer end 64*d*. The inner end 64*c* of the cup member 64 is provided with a substantially cylindrical recess 64*a* therein. The recess 64*a* is coaxially receivable of the resilient member 72 so as to support the resilient member 72. The outer end 64*d* of the cup member 64 is received within an aperture 68 formed in the main frame 14. The cup members can be formed of the same high-temperature structural plastics as the heat shield members, thus providing further shielding of the resilient members from the high temperatures in the environment of the engine cylinder. Preferably, the outer end 64*d* of the cup member 64 has an annular groove 64*e* therein which forms shoulder portions 64*f* and 64*g*. Correspondingly, the aperture 68 may be provided with a section 80 of reduced cross section thereby forming shoulder portions 80*a* and 80*b* these shoulder portions 80*a* and 80*b* abuttingly contact the respective shoulder portions 64*f* and 64*g* of the cup member 64 and prevent movement of the cup member within the aperture 68.

Figure 15:
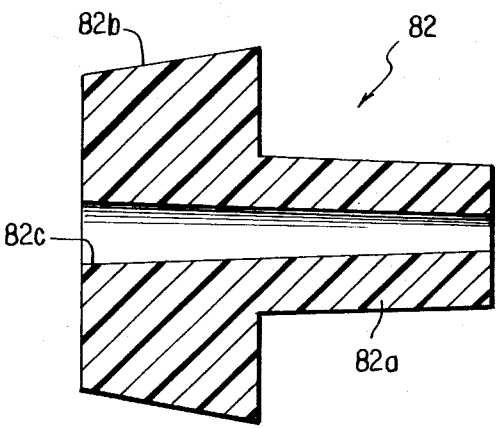
FIG. 15 is a sectional view of a cut control bumper according to the present invention.
Figure 14:
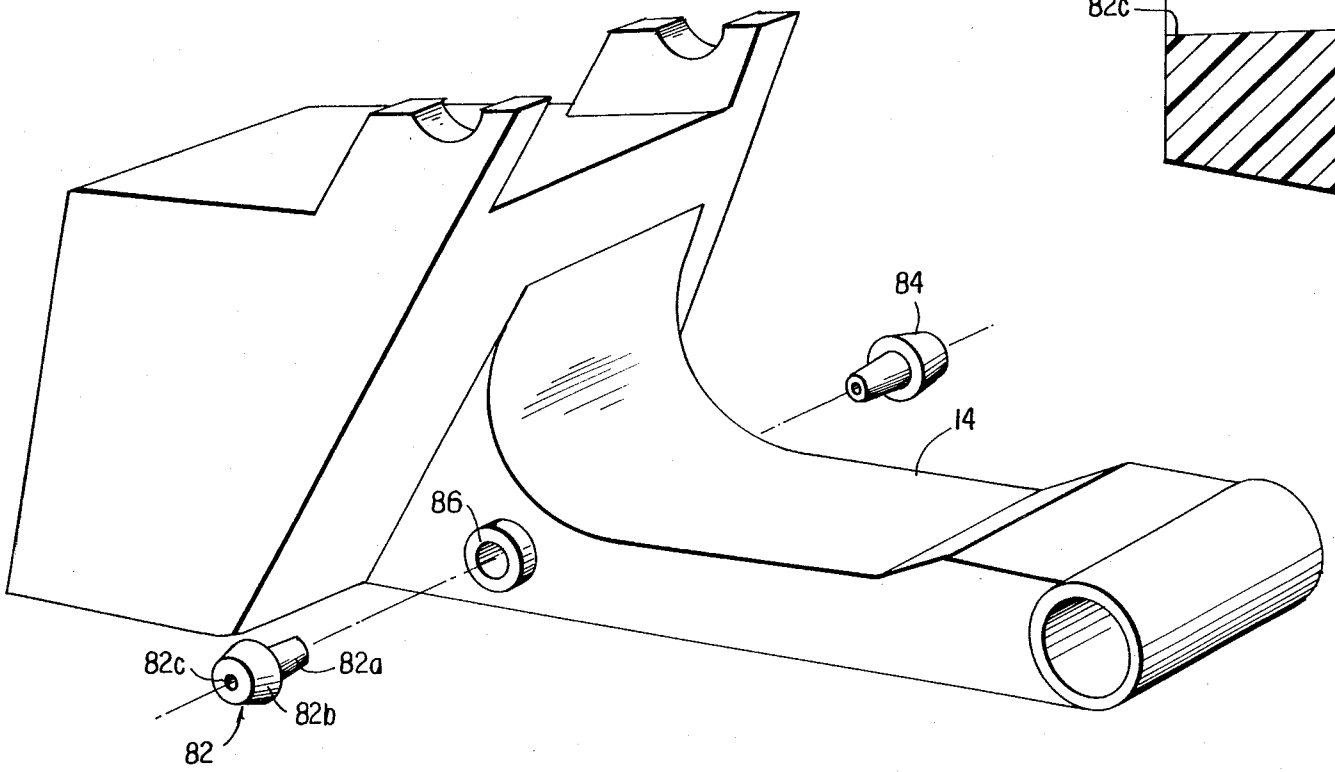
FIG. 14 is a schematic view of a main frame according to the present invention.

As shown in FIGS. 14 and 15, the present invention also provides cut control bumpers which comprise a pair of resilient bumpers 82 and 84, one of the bumpers 82 and 84 disposed on each side of the main frame 14. As may best be seen in FIG. 15 (only one cut control bumper having been illustrated since they are of identical configuration), each bumper 82 comprises a substantially cylindrical body having an axis formed of a first axial portion 82*a* of predetermined diameter and a second axial portion 82*b* of a diameter greater than that of the first axial portion 82*a*. The first axial portion 82*a* is received within in a respective aperture 86 formed in the main frame and the second axial portion 82*b* is disposed intermediate the main frame 14 and the crankcase (not shown). The cut control bumper 82 may be provided with a tapering axial bore 82*c* therethrough so as to facilitate the force fit of the cup control bumper 82 into the aperture 86.

In operation, the present vibration mounting system allows the utilization of rubber mounts (resilient members), e.g., neoprene rubber, in all locations. This is due to the fact that the rubber is either removed from the area of highest heat generation, i.e., the front mount is remote from the cylinder, or the rubber is shielded from adverse exposure to high temperatures, i.e. the rear mount includes a heat shield between the rubber and the cylinder. Thus, relatively inexpensive rubber mounts can be utilized without fear of shortened lifespan (and the concomitant need for replacement) due to high temperature degradation of the rubber. Additionally, by provision of the cut control bumpers, the resilient members may be formed of a rubber having a lower spring rate. In this regard, it should be noted that a softer spring rate of the resilient members will allow greater twisting motion of the vibrating assembly about the first imaginary line. Thus, when a twisting moment is applied to the vibrating assembly, as when the guide bar carrying the cutter chain is pressed against an object to be cut (the guide bar being rigidly connected to the internal combustion engine and acting as a lever arm), the tendency is for the vibrating assembly to twist relative to the support assembly, when using low spring rate supports. However, the cut control bumpers of the present invention prevent this twisting of the vibrating assembly and allow the use of a lower spring rate rubber; a lower spring rate rubber being superior in attenuating the transmission of vibrations as compared to a higher spring rate rubber. Without the use of the cut control bumpers, higher spring rates would have to be used for the rubber of the resilient members, in order to resist the twisting motion, with a concomitant loss in the ability of the mounting system to attenuate the transmission of vibrations.

What is claimed is:

1. A chain saw having reduced transmission of vibration to the user thereof, said chain saw comprising:

a vibrating assembly having a front and a rear and a top and a bottom including an internal combustion engine with at least one cylinder having an axis, a crankcase and a crankshaft having a centerline axis;

a support assembly for supporting the vibrating assembly, the support assembly including a main frame having a front and a rear and at least one manual gripping handle;

vibration isolation means, including at least one shearable compressible resilient member means for attenuating vibration, for connecting said vibrating assembly and said support assembly and inhibiting the transmission of vibrational forces from said vibrating assembly to said support assembly, said vibration isolation means attenuating vibration solely by compression of said shearable compressible resilient member means, said vibration isolation means comprising:

front vibration mount means having a first axis at least substantially parallel to the crankshaft centerline axis for connecting said front of said vibrating assembly to said front of said main frame;

rear vibration mount means having a second axis at least substantially parallel to the crankshaft centerline axis for connecting said rear of said vibrating assembly to said rear of said main frame;

said front vibration mount means and said rear vibration mount means being disposed so that a first imaginary line connecting their axes intersects an imaginary vertical plane containing the crankshaft centerline axis at a point above the crankshaft centerline axis;

said front vibration mount means and said rear vibration mount means cooperating to permit relative twisting movement between said vibrating assembly and said main frame about said imaginary line;

bumper means, having a third axis at least substantially parallel to the crankshaft centerline axis, located between said vibrating assembly and said main frame at a position remote from said first imaginary line, and located such that a second imaginary line connecting said crankshaft centerline axis and said third axis intersects with said first imaginary line at a point further from said bumper means than said crankshaft centerline axis for inhibiting said relative twisting movement between said vibrating assembly and said main frame, whereby transmission of vibration from said vibrating assembly to said support assembly and hence to a user grasping said at least one manual gripping handle is reduced.

2. The chain saw as claimed in claim 1, wherein said front vibration mount means is located forward of and below said crankshaft centerline axis.

3. The chain saw as claimed in claim 1, wherein said rear vibration mount means is located rearward of and above said crankshaft centerline axis.

4. The chain saw as claimed in claim 1, wherein said bumper means are located at a position as far as possible from said first imaginary line.

5. The chain saw as claimed in claim 1, wherein said crankshaft centerline axis lies in a substantially horizontal plane, and said cylinder axis is substantially perpendicular to said horizontal plane said cylinder extending above said horizontal plane.

6. The chain saw as claimed in claim 1, wherein said front vibration mount means includes at least one resilient member and said front vibration mount means attenuates the transmission of vibrations only by compression of said at least one resilient member.

7. The chain saw as claimed in claim 1, wherein said rear vibration mount means includes at least one resilient member and said rear vibration mount means attenuates the transmission of vibrations from said cylinder to said main frame substantially only by compression of said at least one resilient member.

8. The chain saw as claimed in claim 1, wherein said front vibration mount means connects said crankcase to said main frame.

9. The chain saw as claimed in claim 1, wherein said rear vibration mount means connects said cylinder to said main frame.

10. The chain saw as claimed in claim 1, wherein said front vibration mount means comprises pin means extending along said first axis, rigidly connected to said crankcase for supporting said vibrating assembly; recess means, formed in said main frame, for coaxially receiving and supporting said pin means; shearable, compressible resilient member means, intermediate said pin means and said recess means, for maintaining said pin means and said recess means in coaxial spaced apart relationship; said pin means cooperating with said resilient member means to prevent shear of said resilient member means in a plane transverse to said crankcase centerline axis.

11. The chain saw as claimed in claim 10, wherein said crankcase assembly has a right side and a left side, said recess means comprises a pair of axially aligned substantially cylindrical recesses formed in said main frame, one of said pair of recesses formed on the right side of said main frame and the other of said pair of recesses formed on the left side of said main frame; said resilient member means comprises a pair of axially aligned substantially cylindrical resilient members, each of said pair of resilient members having an axial bore therethrough, one of said pair of resilient members coaxially received within said right side recess and the other of said pair of resilient members coaxially received within said left side recess, said resilient members holding said right side of said main frame and said right side of said crankcase assembly and said left side of said main frame and said left side of said crankcase, respectively, in spaced apart relationship, whereby the transmission of vibrations from said crankcase to said main frame, in a direction parallel to the crankshaft centerline axis, is attenuated substantially only by compression of said resilient members; said pin means comprises a pair of rigid pin members, a portion of one of said pin members received within said axial bore of said right side resilient member and the remaining portion of said one pin member rigidly connected to said right side of said crankcase and a portion of the other of said pin members received within said axial bore of said left side resilient member and the remaining portion of said other pin member rigidly connected to said left side of said crankcase, said pin members cooperating with said resilient members to prevent shearing of said resilient members in a plane transverse to the crankshaft centerline axis, whereby the transmission of vibrations from said crankcase to said main frame is attenuated substantially only by compression of said resilient members.

12. The chain saw as claimed in claim 11, wherein each of said pin members comprises a screw having a threaded portion and an unthreaded portion, said unthreaded portion engagingly received within said axial bore in said resilient member, said threaded portion threadingly received within a corresponding threaded aperture in said crankcase assembly.

13. A chain saw comprising a vibrating assembly having a front including an internal combustion engine having a cylinder, a crankcase having a right side and a left side and a crankshaft having a centerline axis;

a support assembly for supporting the vibrating assembly, said support assembly including a main frame having a front and a right side and a left side and at least one manual gripping handle;

front vibration mount means for connecting the front of said crankcase to the front of said main frame and inhibiting the transmission of vibrational forces from said vibrating assembly to said support assembly, said front vibration mount means comprising:

pin means having a first axis parallel to said crankshaft centerline axis for supporting said vibrating assembly, said pin means rigidly connected to said crank-case assembly;

shearable compressible resilient member means having a second axis and an axial bore therethrough for supporting said pin means, said axial bore coaxially receivably engaging at least a portion of said pin means therein;

recess means having a third axis, formed in said main frame, for supporting said shearable compressible resilient member means, said recess means coaxially receivably engaging said shearable compressible resilient member means;

said resilient member means cooperating with said recess means and said crankcase to maintain said main frame and said crankcase in spaced apart relation and to attenuate the transmission of vibration from said vibrating assembly to said support assembly in a direct parallel to said crankshaft centerline axis substantially only by compression of said resilient member means;

said pin means cooperating with said resilient member means to prevent shear of said resilient member means in a plane transverse to said crankshaft centerline axis, whereby said front mount means attenuates the transmission of vibration from said vibrating assembly to said support assembly substantially only by compression of said resilient member means.

14. The chain saw as claimed in claim 13, wherein said resilient member means comprises a pair of axially aligned resilient members, said resilient members received within said recess means.

15. the chain saw as claimed in claim 13, wherein said pin means is of a predetermined length and said recess means is of a predetermined depth whereby a major portion of the length of said pin means is received within said recess means.

16. The chain saw as claimed in claim 13, wherein said main frame is located between said right side of said crankcase and said left side of said crankcase.

17. The chain saw as claimed in claim 13, wherein said pin means comprises a pair of axially aligned pins, each pin rigidly connected to a respective side of said crankcase.

18. The chain saw as claimed in claim 17, wherein each pin comprises a threaded portion and an unthreaded portion; said threaded portion threadingly received in a corresponding threaded aperture in said crankcase, thereby rigidly connecting said pin to said crankcase; said unthreaded portion coaxially engagingly received in said axial bore of said resilient member means.

19. A chain saw comprising a vibrating assembly including an internal combustion engine having a cylinder, a crankcase and a crankshaft having a centerline axis;

a support assembly for supporting the vibrating assembly, said support assembly including a main frame having a rear and a right side and a left side and at least one manual gripping handle;

rear vibration mount means for connecting said cylinder to the rear of said main frame and inhibiting the transmission of vibrational forces from said vibrating assembly to said support assembly, said rear vibration mount means comprising:

roll pins means having end portions and a first axis substantially parallel to said crankshaft centerline axis for supporting said vibrating assembly, said roll pin means rigidly connected to said cylinder;

cup means for coaxially receiving and supporting said roll pin means;

shearable, compressible resilient member means having a second axis, intermediate said roll pin means and said cup means, for maintaining said roll pin means and said cup means in coaxial spaced apart relationship;

heat shield means, intermediate said roll pin means and said resilient member means, for inhibiting heat transfer from said cylinder to said resilient member means;

aperture means, having a third axis, formed in said main frame, for coaxially receivably engaging at least a portion of said cup means and supporting said cup means;

said resilient member means maintaining said vibrating assembly and said support assembly in spaced apart relationship and attenuating the transmission of vibration from said vibrating assembly to said support assembly substantially only by compression of said resilient member means.

20. The chain saw as claimed in claim 19, wherein said cylinder is located between said right side of said main frame and said left side of said main frame.

21. The chain saw as claimed in claim 19, wherein said roll pin means comprises a roll pin having an axis and end portions; said roll pin attached to said cylinder by a pair of bosses formed on the cylinder, said bosses each having an aperture therethrough, said apertures having a common axis, said roll pin press fit through said apertures, said end portions each extending outwardly from a respective cylinder boss.

22. The chain saw as claimed in claim 21, wherein said roll pin has an axial bore therethrough.

23. The chain saw as claimed in claim 21, wherein said heat shield means comprises a pair of heat shield members, each of said pair of heat shield members disposed on a respective end portion of said roll pin.

24. The chain saw as claimed in claim 23, wherein each said heat shield member comprises a substantially planar annular disc portion having a front face and a rear face and an inner edge and an outer edge, an inner cylindrical wall extending substantially perpendicularly from said rear face of said annular disc portion adjacent said inner edge, said front face abuttingly contacting a respective cylinder boss, said inner cylindrical wall defining a hollow cylinder press fittingly receiving a respective end portion of said roll pin.

25. The chain saw as claimed in claim 24, wherein said heat shield members each further comprise a shroud portion extending toward said cylinder in the plane of said annular disc portion, said shroud portion being of substantially trapezoidal shape in plan, the longer of the two parallel sides of the trapezoid being proximate said cylinder and the shorter of the two parallel sides of the trapezoid being integral with said annular disc portion.

26. The chain saw as claimed in claim 24, wherein said resilient member means comprises a pair of axially aligned substantially cylindrical resilient members, each of said pair of resilient members having an axial bore therethrough.

27. The chain saw as claimed in claim 26, wherein said resilient members each comprise a substantially cylindrical body portion having a pair of axially spaced apart rings there and a flange portion extending perpendicular to said axis at one end of said body portion, said flange portion being disposed abuttingly between a respective heat shield member and a respective cup member and said annular rings and the other end of said cylindrical body portion abutting the interior of said recess in said cup member.

28. The chain saw as claimed in claim 26, wherein said cup means comprises a pair of axially aligned substantially cylindrical cup members, each cup member having an inner end and an outer end, said inner ends of said cup members having a substantially cylindrical recess formed therein, each said recess coaxially receiving and supporting a respective resilient member.

29. The chain saw as claimed in claim 28, wherein said aperture means comprises a pair of axially aligned substantially cylindrical holes formed in said main frame, one of said pair of holes formed on the right side of said main frame and the other of said pair of holes formed on the left side of said main frame, the outer ends of said cylindrical cup members each receivingly supported in a respective hole.

30. The chain saw as claimed in claim 28, wherein the other end of said cylindrical body portion extends beyond said roll pin end portion.

31. A chain saw comprising:

a vibrating assembly including an internal combustion engine having a cylinder, a crankcase having a right side and a left side and a crankshaft having a centerline axis;

a support assembly for supporting the vibrating assembly, said support assembly including a main frame having a front and a rear and a right side and a left side, and at least one manual gripping handle;

vibration isolation means for connecting said vibrating assembly to said support assembly and inhibiting the transmission of vibrational forces from said vibrating assembly to said support assembly, said vibration isolation means comprising:

front vibration mount means for connecting said crankcase to the front of said mainframe comprising pin means having a first axis parallel to said crankshaft centerline axis for supporting said vibrating assembly, said pin means rigidly connected to said crankcase; first shearable compressible resilient member means having a second axis parallel to said crankshaft centerline axis and an axial bore therethrough for supporting said pin means, said axial bore coaxially receivably engaging at least a portion of said pin means therein; recess means, having a third axis parallel to said crankshaft centerline axis, formed in said main frame, for supporting said first shearable compressible resilient member means, said recess means coaxially receivably engaging said first shearable compressible resilient member means; said first resilient member means cooperating with said recess means to maintain said main frame and said crankcase in spaced apart relation and to attenuate the transmission of vibration from said vibrating assembly to said support assembly in a direction parallel to said crankshaft centerline axis by compression of said first resilient member means; said pin means cooperating with said first resilient member means to prevent shear of said resilient member means in a plane transverse to said crankshaft centerline axis, whereby said front mount means attenuates the transmission of vibration from said vibrating assembly to said support assembly substantially only by compression of said first resilient member means;

rear vibration mount means for connecting said cylinder to the rear of said main frame comprising roll pin means having end portions and a fourth axis parallel to said crankshaft centerline axis for supporting said vibrating assembly, said roll pin means rigidly connected to said cylinder; second shearable, compressible resilient member means having a fifth axis parallel to said crankshaft centerline axis and an axial bore therethrough for supporting said roll pin means; heat shield means, intermediate said pin means and said second resilient member means, for inhibiting heat transfer from said cylinder to said second resilient member means; cup means having a sixth axis parallel to said crankshaft centerline axis, for supporting said second resilient member means, said cup means coaxially receivably engaging said second resilient member means; aperture means having a seventh axis parallel to said crankshaft centerline axis, formed in said main frame, for coaxially receivably engaging at least a portion of said cup means and supporting said cup means; said second resilient member means maintaining said vibrating assembly and said support assembly in spaced apart relationship and attenuating the transmission of vibration from said vibrating assembly to said support assembly substantially only by compression of said second resilient member means.

32. The chain saw as claimed in claim 31, wherein said pin means is of a predetermined length and said recess means is of a predetermined depth whereby a major portion of the length of said pin means is received within said recess means.

33. The chain saw as claimed in claim 31, wherein said pin means comprises a pair of pins extending along said first axis, each pin rigidly connected to a respective side of said crankcase assembly.

34. The chain saw as claimed in claim 33, wherein each pin comprises a threaded portion and an unthreaded portion; said threaded portion threadingly received in a corresponding threaded aperture in said crankcase, thereby rigidly connecting said pin to said crankcase assembly; said unthreaded portion coaxially engagingly received in said axial bore of said resilient member means.

35. The chain saw as claimed in claim 31, wherein said recess means comprises a pair of axially aligned cup-like recesses formed in said main frame, one of said pair of recesses formed on the right side of said main frame and the other of said pair of recesses formed on the left side of said main frame; said first resilient member means compresses a pair of axially aligned first resilient members, each first resilient member received within a respective cup-like recess formed in a respective side of said main frame.

36. The chain saw as claimed in claim 35, wherein each first resilient member comprises a substantially cylindrical body having an axial bore therethrough, at least two axially spaced apart annular rings formed on said cylindrical body, a flange extending perpendicular to said axis at one end of said cylindrical body; the other end of said cylindrical body and said at least two axially spaced apart annular rings abuttingly engaging said cup-like recess, said flange abuttingly engaging on opposite sides thereof a respective side of said main frame and a respective side of said crankcase.

37. The chain saw as claimed in claim 31, wherein said axis of said pin means and said axis of said roll pin means are each parallel to said crankshaft centerline axis.

38. The chain saw as claimed in claim 37, wherein an imaginary line connecting said pin means axis and said roll pin means axis intersects an imaginary vertical plane containing the crankshaft centerline axis at a point above the crankshaft centerline axis.

39. The chain saw as claimed in claim 31, wherein said roll pin means comprises a roll pin extending along said fourth axis and end portions; said roll pin attached to said cylinder by a pair of bosses formed on the cylinder; said bosses each having an aperture therethrough, said apertures having a common axis, said roll pin press fit through said apertures, said end portions each extending outwardly from a respective cylinder boss.

40. The chain saw as claimed in claim 39, wherein said roll pin has an axial bore therethrough.

41. The chain saw as claimed in claim 39, wherein said heat shield means comprises a pair of heat shield members, each of said pair of heat shield members disposed on a respective end portion of said roll pin.

42. The chain saw as claimed in claim 41, wherein each said heat shield member comprises a substantially planar annular disc portion having a front face and a rear face and an inner edge and an outer edge, an inner cylindrical wall extending substantially perpendicularly from said rear face of said annular disc portion adjacent said inner edge, said front face abuttingly contacting a respective cylinder boss, said inner cylindrical wall defining a hollow cylinder press fittingly receiving a respective end portion of said roll pin.

43. The chain saw as claimed in claim 42, wherein said heat shield members each further comprise a shroud portion extending toward said cylinder in the plane of said annular disc portion, said shroud portion being of substantially trapezoidal shape in plan, the longer of the two parallel sides of the trapezoid being proximate said cylinder and the shorter of the two parallel sides of the trapezoid being integral with said annular disc portion.

44. The chain saw as claimed in claim 43, wherein said second resilient member means comprises a pair of axially aligned substantially cylindrical second resilient members, each of said pair of second resilient members having an axial bore therethrough.

45. The chain saw as claimed in claim 44, wherein each of said second resilient members comprises a substantially cylindrical body portion having a pair of axially spaced apart rings thereon and a flange portion extending perpendicular to said axis at one end of said body portion, said flange portion being disposed abuttingly between a respective heat shield member and a respective cup member and said annular rings and the other end of said cylindrical body portion abutting the interior of said recess in said cup member.

46. The chain saw as claimed in claim 45, wherein said cup means comprises a pair of axially aligned substantially cylindrical cup members, each cup member having an inner end and an outer end, said inner ends of said cup members having a substantially cylindrical recess formed therein each said recess coaxially receiving and supporting a respective second resilient member.

47. The chain saw as claimed in claim 46, wherein said aperture means comprises a pair of axially aligned substantially cylindrical holes formed in said main frame, one of said pair of holes formed on the right side of said main frame and the other of said pair of holes formed on the left side of said main frame, the outer ends of said cylindrical cup members each receivingly supported in a respective hole.

48. A chain saw having reduced transmission of vibration to the user thereof, said chain saw comprising:

a vibrating assembly having a front and a rear and a top and a bottom including an internal combustion engine with at least one cylinder having an axis, a crankcase and a crankshaft having a centerline axis;

a support assembly for supporting the vibrating assembly, the support assembly including a main frame having a front and a rear and at least one manual gripping handle;

vibration isolation means, including at least one shearable compressible resilient member means for attenuation vibration, for connecting said vibrating assembly and said support assembly and inhibiting the transmission of vibrational forces from said vibrating assembly to said support assembly, said vibration isolation means attenuating vibration solely by compression of said shearable compressible resilient member means, said vibration isolation means comprising:

front vibration mount means having a first axis at least substantially parallel to the crankshaft centerline axis for connecting said front of said vibrating assembly to said front of said main frame;

rear vibration mount means having a second axis at least substantially parallel to the crankshaft centerline axis for connecting said rear of said vibrating assembly to said rear of said main frame;

said front vibration mount means and said rear vibration mount means being disposed so that a first imaginary line connecting their axes intersects an imaginary vertical plane containing the crankshaft centerline axis at a point above the crankshaft centerline axis;

said front vibration mount means and said rear vibration mount means cooperating to permit relative twisting movement between said vibrating assembly and said main frame about said imaginary line;

bumper means, having a third axis at least substantially parallel to the crankshaft centerline axis, located between said vibrating assembly and said main frame at a position remote from said first imaginary line, and located such that a second imaginary line connecting said crankshaft centerline axis and said third axis intersects with said first imaginary line at a point further from said bumper means than said crankshaft centerline axis for inhibiting said relative twisting movement between said vibrating assembly and said main frame, whereby transmission of vibration from said vibrating assembly to said support assembly and hence to a user grasping said at least one manual gripping handle is reduced; and wherein said rear vibration mount means comprises roll pin means extending along said second axis, rigidly connected to said cylinder, for supporting said vibrating assembly; cup means for coaxially receiving and supporting said roll pin means; aperture means, formed in said main frame, for receivingly supporting said cup means; shearable compressible resilient member means, intermediate said roll pin means and said cup means, for maintaining said roll pin means and said cup means in coaxial spaced apart relationship; said roll pin means cooperating with said resilient member means to prevent shear of said resilient member means in a plane transverse to said crankshaft centerline axis; heat shield means, intermediate said roll pin means and said resilient member means, for inhibiting heat transfer to said resilient member means from said cylinder.

49. The chain saw as claimed in claim 48, wherein said roll pin means comprises a roll pin having end portions, said roll pin attached to said cylinder by a pair of bosses extending from said cylinder, said bosses each having a bore therethrough extending along said second alia, said bores coaxially aligned with one another, said roll pin press fit through said bores with said end portions extending outboard of respective bosses; said shearable compressible resilient member means comprises a pair of axially aligned substantially cylindrical resilient members, each of said pair of resilient members having an axial bore therethrough, one of said roll pin end portion received within the axial bore of one of said pair of resilient members and the outer of said roll pin end portions received within the axial bore of the other of said pair of resilient members; said heat shield means comprises a pair of substantially rigid heat shield members, a first portion of each of said heat shield members located intermediate a respective roll pin end portion and a respective resilient member and a second portion of each of said heat shield members located intermediate a respective boss and a respective resilient member; said cup means comprises a pair of axially aligned substantially cylindrical cup members, each cylindrical cup member having an inner end and an outer end, said inner ends of said cylindrical cup members having a substantially cylindrical recess formed therein, each said recess coaxially receiving and supporting a respective resilient member; said aperture means comprises a pair of axially aligned substantially cylindrical holes formed in said main frame, one of said pair of holes formed on the right side of said frame and the other of said pair of holes formed on the left side of said main frame, the outer ends of said cylindrical cup members each receivingly supported in a respective hole, whereby the transmission of vibrations from said cylinder to said main frame is attenuated substantially only by compression of said resilient members.

50. The chain saw as claimed in claim 49, wherein said roll pin has an axial bore extending therethrough.

51. The chain saw as claimed in claim 49, wherein said roll pin comprises a hollow substantially cylindrical body extending along said second axis and having a predetermined length, said cylindrical body having a slit therethrough extending parallel to said second axis over the entire length of the body.

52. The chain saw as claimed in claim 49, wherein said heat shield members each comprise a substantially planar annular disc portion having a front face and a rear face and an inner edge and an outer edge, an inner cylindrical wall extending substantially perpendicular from said rear face of said annular disc portion adjacent said inner edge, said front face abuttingly contacting a respective cylinder boss, said inner cylindrical wall defining a hollow cylinder press fittingly receiving a respective end portion of said roll pin.

53. The chain saw as claimed in claim 52, wherein said heat shield members each further comprise a shroud portion extending toward said cylinder in the plane of said annular disc portion, said shroud portion being of substantially trapezoidal shape in plan, the longer of the two parallel sides of the trapezoid being proximate said cylinder and the shorter of the two parallel sides of the trapezoid being integral with said annular disc portion.

54. The chain saw as claimed in claim 49, wherein said resilient members each comprise a substantially cylindrical body portion having a pair of axially spaced apart annular rings thereon and a flange portion extending perpendicular to said axis at one end of said body portion, said flange portion being disposed abuttingly between a respective heat shield member and a respective cup member and said annular rings and the other end of said cylindrical body portion abutting the interior of said recess in said cup member.

55. The chain saw as claimed in claim 54, wherein the other end of said cylindrical body portion extends beyond said roll pin end portion.

56. A chain saw having reduced transmission of vibration to the user thereof, said chain saw comprising:

a vibrating assembly having a front and a rear and a top and a bottom including an internal combustion engine with at least one cylinder having an axis, a crankcase and a crankshaft having a certerline axis;

a support assembly for supporting the vibrating assembly, the support assembly including a main frame having a front and a rear and at least one manual gripping handle;

vibration isolation means, including at least one shearable compressible resilient member means for attenuating vibration for connecting said vibrating assembly and said support assembly and inhibiting the transmission of vibrational forces from said vibrating assembly of said support assembly, said vibration isolation means attenuating vibration solely by compression of said shearable compressible resilient member means, said vibration isolation means comprising:

front vibration mount means having a first axis at least substantially parallel to the crankshaft centerline axis for connecting said front of said vibrating assembly to said front of said main frame;

rear vibration mount means having a second axis at least substantially parallel to the crankshaft centerline axis for connecting said rear of said vibrating assembly to said rear of said main frame;

said front vibration mount means and said rear vibration mount means being disposed so that a first imaginary line connecting their axes intersects an imaginary vertical plane containing the crankshaft centerline axis at a point above the crankshaft centerline axis;

said front vibration mount means and said rear vibration mount means cooperating to permit relative twisting movement between said vibrating assembly and said main frame about said imaginary line;

bumper means, having a third axis at least substantially parallel to the crankshaft centerline axis, located between said vibrating assembly and said main frame at a position remote from said first imaginary line, and located such that a second imaginary line connecting said crankshaft centerline axis and said third axis intersects with said first imaginary line at a point further from said bumper means than said crankshaft centerline axis, for inhibiting said relative twisting movement between said vibrating assembly and said main frame, whereby transmission of vibration from said vibrating assembly to said support assembly and hence to a user grasping said at least one manual gripping handle is reduced; and wherein said front vibration mount means comprises pin means extending along said first axis, rigidly connected to said crankcase for supporting said vibrating assembly; recess means, formed in said main frame, for coaxially receiving and supporting said pin means; shearable, compressible resilient member means, intermediate said pin means and said recess means, for maintaining said pin means and said recess means in coaxial spaced apart relationship; said pin means cooperating with said resilient member means to prevent shear of said resilient member means in a plane transverse to said crankcase centerline axis; and wherein said crankcase assembly has a right side and a left side, said recess means comprises a pair of axially aligned substantially cylindrical recesses formed in said main frame, one of said pair of recesses formed on the right side of said main frame and the other of said pair of recesses formed on the left side of said main frame; said resilient member means comprises a pair of axially aligned substantially cylindrical resilient members, each of said pair of resilient members having an axial bore therethrough, one of said pair of resilient members coaxially received within said right side recess and the other of said pair of resilient members coaxially received within said left side recess, said resilient members holding said right side of said main frame and said right side of said crankcase assembly and said left side of said main frame and said left side of said crankcase, respectively, in spaced apart relationship, whereby the transmission of vibrations from said crankcase to said main frame, in a direction parallel to the crankshaft centerline axis, is attenuated substantially only by compression of said resilient members; said pin means comprises a pair of rigid pin members, a portion of one of said pin members received within said axial bore of said right side resilient member and the remaining portion of said one pin member rigidly connected to said right side of said crankcase and a portion of the other of said pin members received within said axial bore of said left side resilient member and the remaining portion of said other pin member rigidly connected to said left side of said crankcase, said pin members cooperating with said resilient members to prevent shearing of said resilient members in a plane transverse to the crankshaft centerline axis, whereby the transmission of vibrations from said crankcase to said main frame is attenuated substantially only by compression of said resilient members; and wherein each of said resilient members comprise a substantially cylindrical body portion having a pair of axially spaced apart annular rings thereon and a flange portion extending perpendicular to said first axis at one end of said body portion, said flange portion being disposed abuttingly between said main frame and said crankcase assembly and said annular rings and the other end of said cylindrically body portion abutting the interior of said recess in said main frame.

57. A chain saw having reduced transmission of vibration to the user thereof, said chain saw comprising:

a vibrating assembly having a front and a rear and a top and a bottom including an internal combustion engine with at least one cylinder having an axis, a crankcase and a crankshaft having a centerline axis;

a support assembly for supporting the vibrating asembly, the support assembly including a main frame having a front and a rear and at least one manual gripping handle;

vibration isolation means, including at least one shearable compressible resilient member means for attenuating vibration, for connecting said vibrating assembly and said support assembly and inhibiting the transmission of vibrational forces from said vibrating assembly to said support assembly, said vibration isolation means attenuating vibration solely by compression of said shearable compressible resilient member means, said vibration isolation means comprising;

front vibration mount means having a first axis at least substantially parallel to the crankshaft centerline axis for connecting said front of said vibrating assembly to said front of said main frame;

rear vibration mount means having a second axis at least substantially parallel to the crankshaft centerline axis for connecting said rear of said vibrating assembly to said rear of said main frame;

said front vibration mount means and said rear vibration mount means being disposed so that a first imaginary line connecting their axes intersects an imaginary vertical plane containing the crankshaft centerline axis at a point above the crankshaft centerline axis;

said front vibration mount means and said rear vibration mount means cooperating to permit relative twisting movement between said vibrating assembly and said main frame about said imaginary line;

bumper means, having a third axis at least substantially parallel to the crankshaft centerline axis, located between said vibrating assembly and said main frame at a position remote from said first imaginary line, and located such that a second imaginary line connecting said crankshaft centerline axis and said third axis intersects with said first imaginary line at a point further from said bumper means than said crankshaft centerline axis for inhibiting said relative twisting movement between said vibrating assembly and said main frame, whereby transmission of vibration from said vibrating assembly to said support assembly and hence to a user grasping said at least one manual gripping handle is reduced; and wherein said bumper means comprises a pair of resilient bumpers, one disposed on each side of said main frame, each said bumper comprising a substantially cylindrical body extending along said third axis, said cylindrical body having a first axial portion of predetermined diameter and a second axial portion of a diameter greater than that of said first axial portion; said first axial portion receivable within a respective aperture formed in said main frame and said second axial portion abuttingly engaging a corresponding portion of said vibrating assembly.

58. A chain saw comprising a vibrating assembly having a front including an internal combustion engine having a cylinder, a crankcase having a right side and a left side and a crankshaft having a centerline axis;

a support assembly for supporting the vibrating assembly, said support assembly including a main frame having a front and a right side and a left side and at least one manual gripping handle;

front vibration mount means for connecting the front of said crankcase to the front of said main frame and inhibiting the transmission of vibrational forces from said vibrating assembly to said support assembly, said front vibration mount means comprising:

pin means having a first axis parallel to said crankshaft centerline axis for supporting said vibrating assembly, said pin means rigidly connected to said crankcase assembly;

shearable compressible resilient member means having a second axis and an axial bore therethrough for supporting said pin means, said axial bore coaxially receiving engaging at least a portion of said pin means therein;

recess means having a third axis, formed in said main frame, for supporting said shearable compressible resilient member means, said recess means coaxially receivably engaging said shearable compressible resilient member means;

said resilient member means cooperating with said recess means and said crankcase to maintain said main frame and said crankcase in spaced apart relation and to attenuate the transmission of vibration from said vibrating assembly to said support assembly in a direct parallel to said crankshaft centerline axis substantially only by compression of said resilient member means;

said pin means cooperating with said resilient member means to prevent shear of said resilient member means in a plane transverse to said crankshaft centerline axis, whereby said front mount means attenuates the transmission of vibration from said vibrating assembly to said support assembly substantially only by compression of said resilient member means; and wherein said resilient memeber means comprises a pair of axially aligned resilient members, said resilient members received within said recess means; and wherein said recess means comprises a pair of axially aligned cuplike recesses formed in said main frame, one of said pair of recess formed on the right side of said main frame and the other of said pair of recesses formed on the left side of said main frame; each resilient member received within a respective cup-like recess formed in a respective side of said main frame; each resilient member comprises a substantially cylindrical body having an axial bore therethrough, at least two axially spaced apart annular rings formed on said cylindrical body, a flange extending perpendicular to said axis at one end of said cylindrical body; the other end of said cylindrical body and said at least two axially spaced apart annular rings abuttingly engaging the interior of said cup-like recess, said flange abuttingly engaging on opposite sides thereof a respective side of said main frame and a respective side of said crankcase.

* * * * *